United States Patent [19]

Hiroaki

[11] Patent Number: 4,606,509

[45] Date of Patent: Aug. 19, 1986

[54] APPARATUS FOR FINDING THE PICKING END OF YARN

[75] Inventor: Sanno Hiroaki, Nonoichi, Japan

[73] Assignee: Murao Boki Kabushiki Kaisha, Kanazawa, Japan

[21] Appl. No.: 746,276

[22] Filed: Jun. 19, 1985

[30] Foreign Application Priority Data

Jun. 27, 1984 [JP] Japan ..... 59-132785

[51] Int. Cl.[4] ..... B65H 54/00; B65H 67/08

[52] U.S. Cl. ..... 242/35.6 R; 242/18 EW; 242/35.6 E

[58] Field of Search ..... 242/35.6 E, 35.6 R, 242/35.5 R, 35.5 A, 18 EW

[56] References Cited

U.S. PATENT DOCUMENTS

| | | | |
|---|---|---|---|
| 2,670,150 | 2/1954 | Perry et al. | 242/35.6 R |
| 3,279,712 | 10/1966 | Furst | 242/35.5 R |
| 3,295,775 | 1/1967 | Raasch et al. | 242/35.5 R |
| 3,544,018 | 12/1970 | Stoppard et al. | 242/35.6 R |
| 3,727,852 | 4/1973 | Nelson et al. | 242/35.6 R |
| 4,544,107 | 10/1985 | Matsui et al. | 242/35.5 A |

*Primary Examiner*—Stanley N. Gilreath

*Attorney, Agent, or Firm*—Oblon, Fisher, Spivak, McClelland & Maier

[57] ABSTRACT

An apparatus for facilitating the finding of the picking end of a yarn wound around a bobbin. The picking end of yarn is passed through the bore of the bobbin from top to bottom so as to be separated from the other and thereof and the yarn lines coiled around the bobbin, thereby avoiding the picking end of the yarn becoming lost or tangled with the other portions of the yarn.

3 Claims, 13 Drawing Figures

APPARATUS FOR FINDING THE PICKING END OF YARN

BACKGROUND OF THE INVENTION

1. Field of the Invention

The present invention relates to an apparatus for facilitating the finding of the picking end of a yarn wound around a bobbin, wherein the picking end means the end of the yarn with which the whole yarn is drawn out of the bobbin in the subsequent process.

2. Description of the Prior Art

In order to explain the background of the invention, reference will be made to FIGS. 2 to 4:

A fresh yarn from a spinning machine is wound around a bobbin to be in preparation for the subsequent process. To supply the yarn to a cheese or the like, the first thing done by the operator is to find the picking end of the yarn wound around the bobbin. Then the picking end of the yarn is tied by hand to the terminating end of the yarn already wound around the cheese or the like. This is a labor-and time-consuming work.

Recently the speed of winders has been accelarated, and the yarn treating process has become highly automated. The manual work cannot catch up with such speedy and automatic practice. In order to overcome this difficulty, many types of automatic winders have been developed so as to find the picking end of the yarn wound around the bobbin and to tie the same to the bobbin portion of the bobbin automatically. As shown in FIG. 4, the bobbin is hollow or has a bore 2*a* axially produced, the bore being open in the opposite end faces. The yarn is wound around the bobbin from bottom to top. The starting end of the yarn 1*a* remains in the bottom portion of the bobbin. The terminating end portion of the yarn 1*b* is coiled around the wound yarn a few turns as shown in FIG. 2, which is commonly called a doffing coil. At the bottom of the bobbin the doffing coil 1*b* is overlaid on itself a few turns, thereby holding the starting end of the yarn 1*a*. The reference numeral 1*c* indicates this overlaid portion of the yarn. The terminating end and the starting end respectively dangle like animal's tails as shown in FIG. 2. The terminating end of the yarn is subsequently used as the picking end.

When the yarn is unwound from the bobbin, the doffing coil is firstly uncoiled, and the uncoiled portion is straightly turned in the central portion of the wound yarn as shown 1d in FIG. 3. This is done by making the bobbin rotate automatically. During the rotation, the end of the yarn is likely to be lost in the confusingly many yarn lines. In addition, the top and the terminating ends are likely to become tangled with each other. To eliminate the tangles, it becomes necessary to cut the tangled portion, which leads to the waste of yarn.

To avoid the problem of tangling, the common practice is to pass the picking portion of the yarn through the bore of the bobbin from top to bottom as shown at 1*f*. In FIG. 4 the yarn enters the bobbin at 1*e*. This practice is now in extensive use because of the advantages that the picking end of the yarn is easily found, thereby facilitating the winding of yarn around a winder, and that it is not necessary to rotate the bobbins.

However, this practice requires a complicated apparatus, which often causes troubles or breakdowns. Due to the frequent stops of operation the working efficiency is immensely reduced.

OBJECTS OF THE INVENTION

The present invention is directed to solving the problems pointed out with respect to the conventional practice, and it has for its principal object the provision of an apparatus for facilitating the finding of the picking end of the yarn wound around the bobbin.

Other objects and advantages of the present invention will become more apparent from the following description when taken in conjunction with the accompanying drawings, which shows, for the purpose of illustration only, one embodiment in accordance with the present invention.

SUMMARY OF THE INVENTION

According to the present invention, there is provided an apparatus for facilitating the finding of the picking end of a yarn wound around a bobbin. The apparatus includes a bobbin holding means for supporting each bobbin horizontally; and a sucking means provided adjacent to the bobbin holding means, the sucking means including a first sucking means for subjecting the bobbin to a longitudinal sucking pressure, and a second sucking means for sucking the bobbin laterally. The second sucking means forms an L-shape with the first sucking means. A chute allows the bobbin sucked through the second sucking means to fall down. The chute includes means for allowing the bobbin to roll down longitudinally. A conveyor receives the bobbins thereon. The conveyor includes hollow pegs for erecting the bobbin thereon. A suction pipe is provided under the conveyor so that the suction pipe sucks the air in the bore of the bobbin when it is in agreement with the hollow peg. Means for guiding a sucked yarn, are provided in the second sucking means.

A first cutting means is provided between an end of the bobbin and the first sucking means. The first cutting means is worked so as to cut the tail end of the yarn when the bobbin is subjected to the sucking pressure in the first sucking means.

A second cutting means is provided between the guiding means and the conveyor. The second cutting means is worked so as to cut the picking end portion of the yarn to a fixed length.

BRIEF DESCRIPTION OF THE DRAWINGS

FIGS. 2, 3 and 4 are side views exemplifying the conventional practice under which the picking end of yarn is prepared for the subsequent process, of which FIG. 4 shows the internal structure of the bobbin;

DETAILED DESCRIPTION OF THE PREFERRED EMBODIMENT

Figure 5:
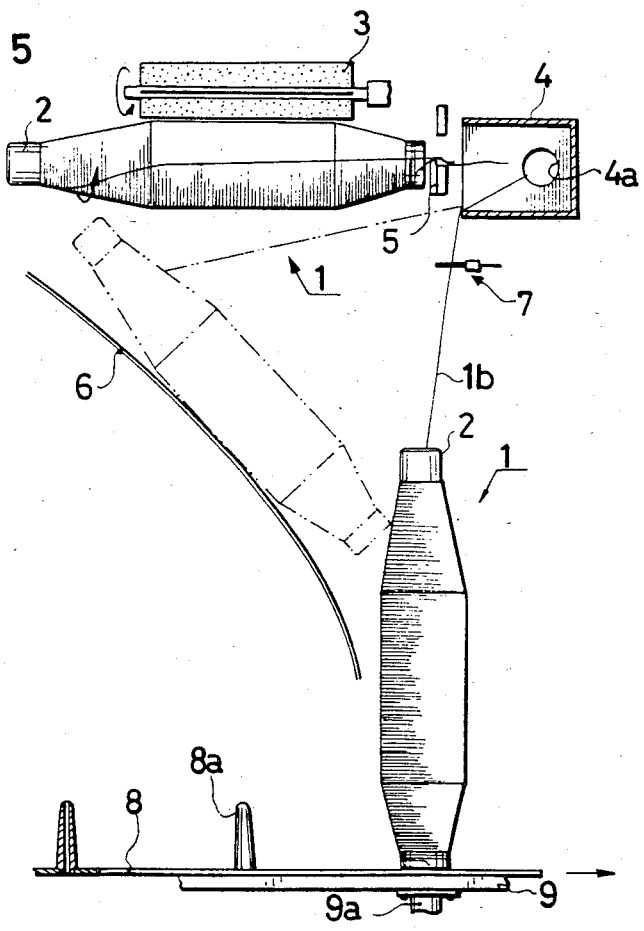
FIG. 5 is a schematic view exemplifying how a yarn wound bobbin is treated under the present invention.

Referring to FIG. 5, the invention will be schematically described first:

The reference numeral 1 designates a yarn which is wound around a bobbin in the spinning process. The bobbin per se is indicated by the reference numeral 2. Hereinafter, the yarn 1 means a yarn wound around a bobbin 2. Likewise, the reference numeral 2 means a bobbin (not shown in FIG. 5) having a yarn wound thereon.

The bobbins 2 are horizontally supported by means of a rotary bobbin feeder drum 12 having a plurality of bobbin support means. The rotary bobbin feed drum 12 will be hereinafter described in greater detail. There is provided a beater 3 located adjacent to the feeder drum 12. The beater 3 is adapted to keep contact with the yarn surface so as to raise the doffing coil to facilitate the finding of the picking end of the yarn 1.

Figure 13:
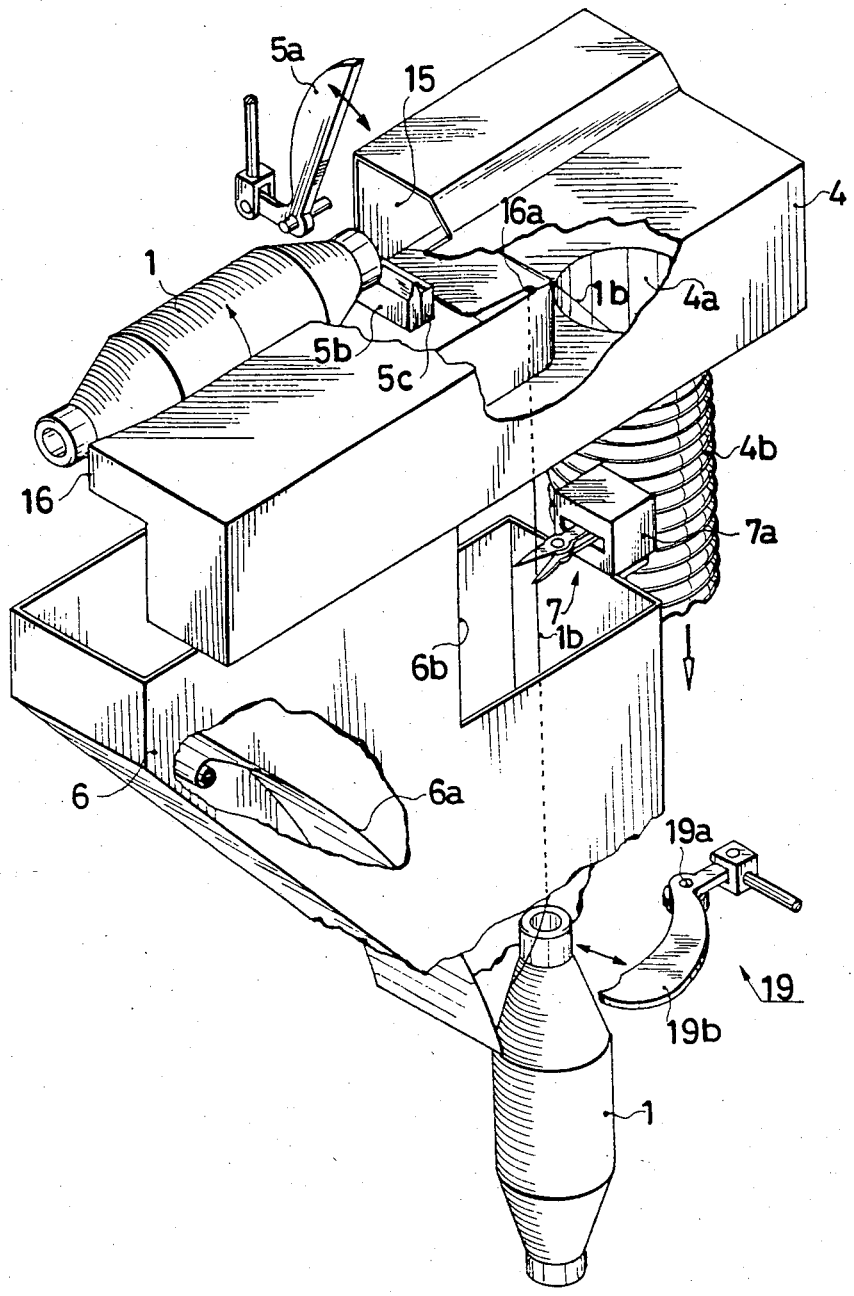
FIG. 13 is a perspective view, partly broken to show the internal structure, of the apparatus according to the present invention.

The yarn 1 is subjected to a sucking air pressure introduced through a suction nozzle 4. The sucking pressure is produced by means of a fan 4*c* (FIG. 1) through an inlet 4*a*. The picking end of the yarn is sucked, and when the bobbin 2 falls onto a chute 6, the sucked yarn portion is caught in a slit 16*a* (FIG. 13.)

There is provided a conveyor 8 which is provided with hollow pegs 8*a* for holding each bobbin 2 erected thereon. The hollow in each peg 8*a* is intended to allow the air in the bore of the bobbin to be sucked therethrough, when the peg 8*a* is in alignment with the bore 2*a* of the bobbin 2. There is provided a fixed seat 9, which has a pipe 9*a* through which the air in the bore of the bobbin is sucked via the hollow peg 8*a* in the aforementioned manner. More particularly, when the conveyor 8 comes on the fixed seat 9, and when the bottom opening of the peg 8*a* is in agreement with the pipe 9*a*, the air inside the bobbin 2 is sucked downwardly, thereby sucking the picking end portion 1*b* of the yarn. The reference numerals 5 and 7 designate a nipper unit and a cutter, respectively. The tail end of the yarn is sucked into the sucking nozzle 4 for removal. In this way the picking end portion of the yarn is passed through the bobbin 2, and comes out of the other end opening of the bobbin.

Figure 1:
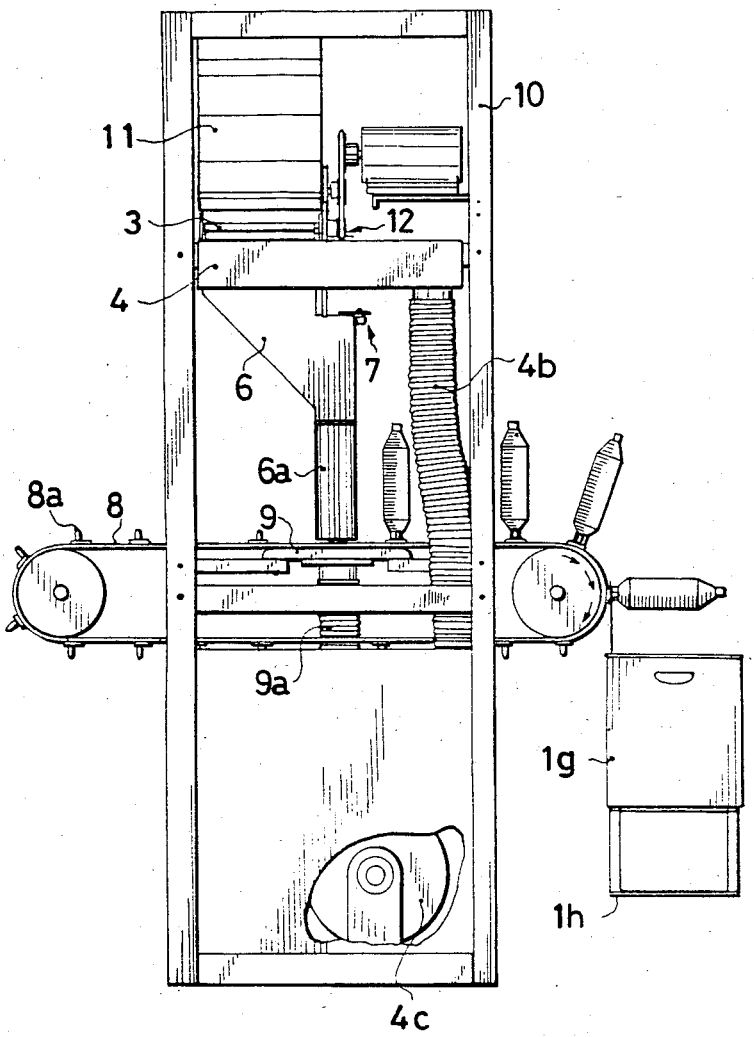
FIG. 1 is a schematic front view showing an apparatus embodying the present invention.
Figure 2:
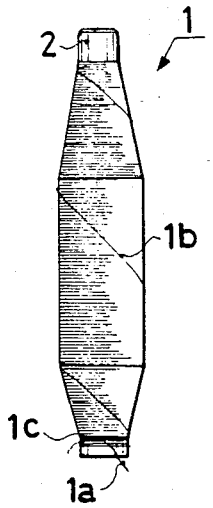
Figure 3:
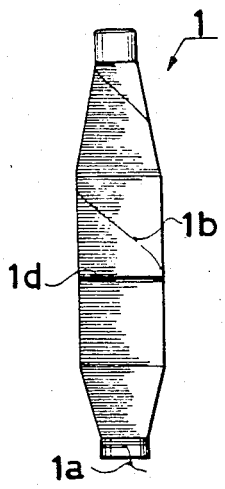
Figure 4:
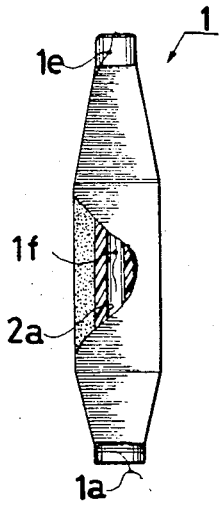
Figure 6:
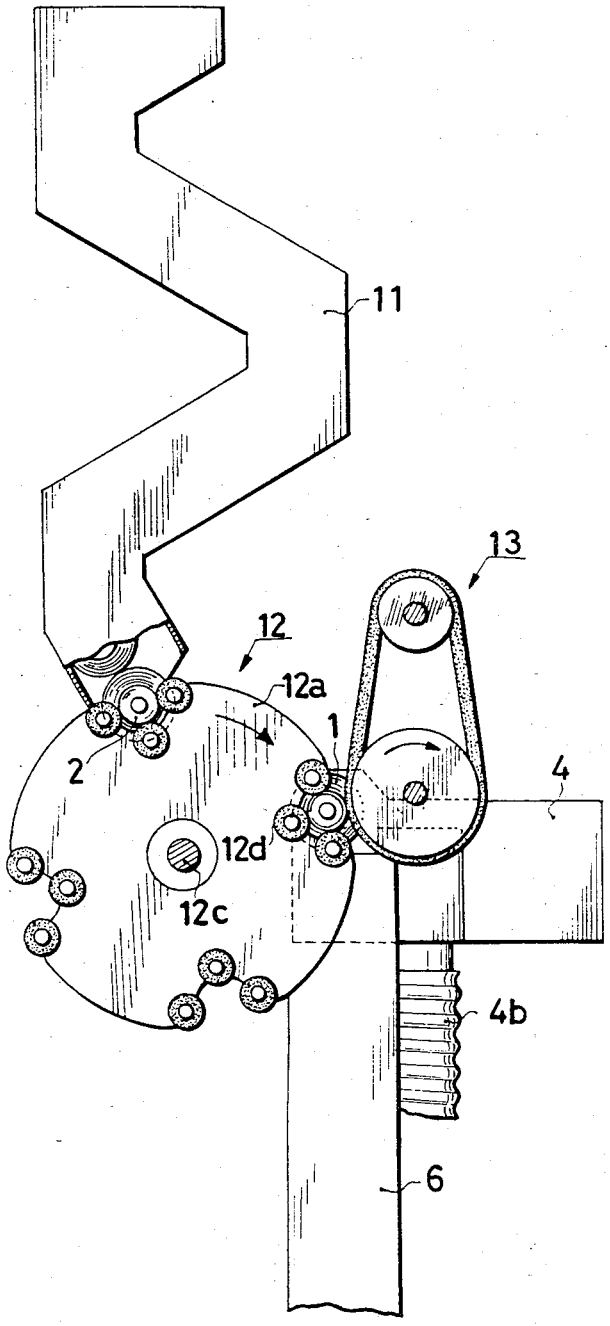
FIG. 6 is a left-hand side view on an enlarged scale of the apparatus of FIG. 1.
Figure 7:
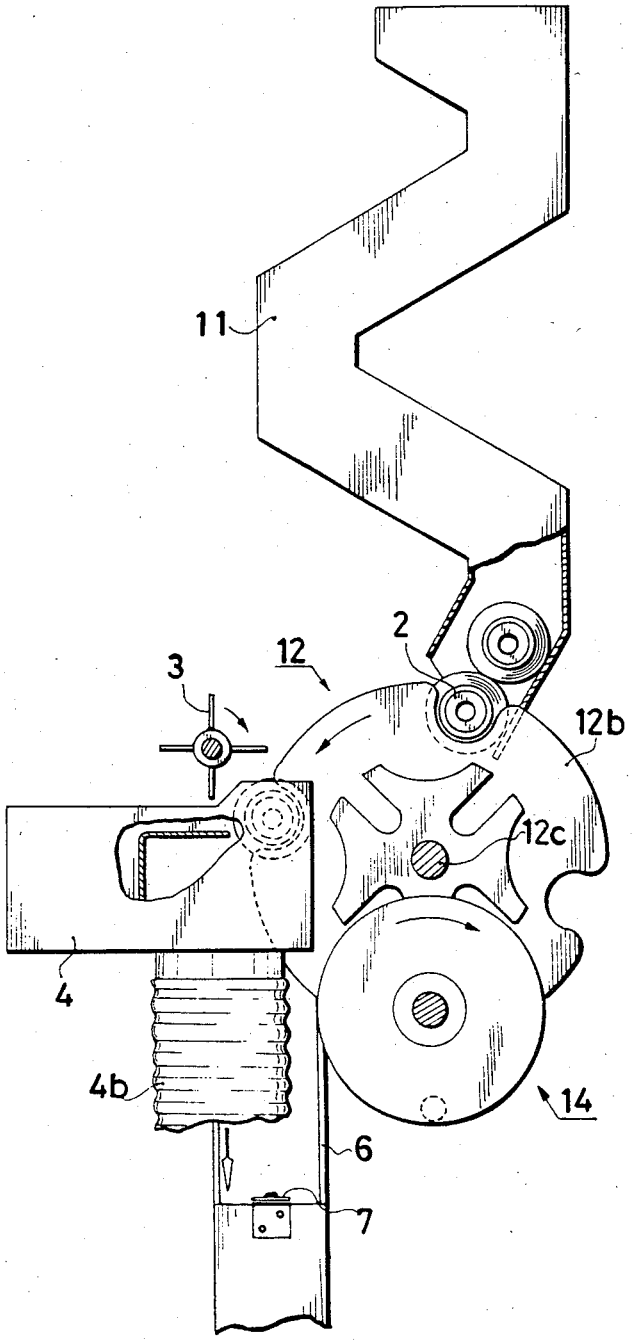
FIG. 7 is a right-hand side view, partly omitted, of the apparatus of FIG. 1.

The invention will be described in greater detail:

Referring to FIG. 1, the apparatus is mounted on a frame 10, which includes a zigzag chute 11 through which the bobbins 2 roll down as best shown in FIGS. 6 and 7. The zigzag chute 11 terminates at a point adjacent to the rotary feeder drum 12. This drum 12, while in rotation, feeds the yarn 1 one by one. There is provided a bobbin rotating device 13 (FIG. 6) located adjacent to the feeder drum 12. This device 13 is kept in contact with a bobbin 2 positioned nearest thereto, thereby causing the same to rotate. The reference numeral 6*a* designates a guide for enabling each bobbin 2 to fall in its longitudial posture, and to be securely erected on the peg 8*a* in a corresponding aforementioned manner. The reference numeral 1*g* designates a bobbin collector, which is located above a belt conveyor 1*h*.

Figure 8:
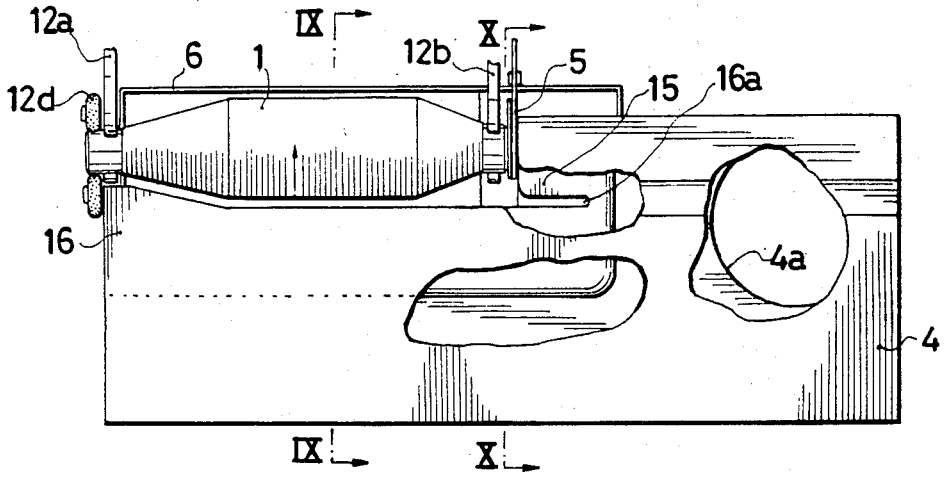
FIG. 8 is a plan view showing the section of the apparatus shown in FIG. 6.
Figure 9:
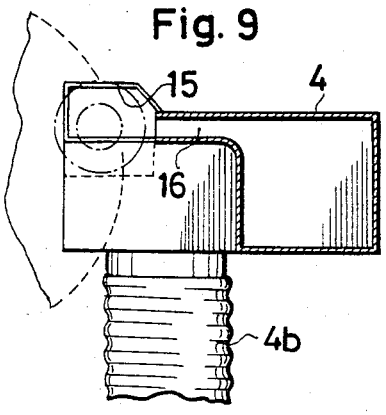
FIGS. 9 and 10 are vertical cross-sections taken along the IX—IX and the X—X line in FIG. 8, respectively.

FIG. 6 shows the left-hand side of the feeder drum 12, and FIG. 7 shows the right-hand side thereof. As shown in FIG. 8, the feeder drum 12 is provided with discs 12*a* and 12*b* spaced sufficiently to hold the bobbins 2 therebetween. The reference numeral 12*c* designates an intermittently driven spindle whereby the feeder drum 12 is rotated intermittently by means of a Geneva device 14. The reference numeral 12*d* designates rollers for supporting the tail end portions of the bobbins 2.

In this way each bobbin 2 supplied from the zigzag chute 11 is individually supported between the discs 12*a* and 12*b* of the feeder drum 12. The bobbin rotating device 13 rotates the bobbin positioned nearest in the direction indicated by the arrow in FIG. 8. As shown in FIG. 5, the beater 3 keeps contact with the yarn surface on the bobbin 2, so as to raise the doffing coil to facilitate the find of the picking end of yarn.

The suction nozzle 4 includes a first sucking opening 15 (FIG. 8) through which a yarn end is sucked, the first sucking opening 15 being located adjacent to the tail end of the bobbin 2 as best shown in FIG. 13. In addition, the suction nozzle 4 includes a second sucking opening 16 forming an L-shape with the first sucking opening 15, through which the bobbins are sucked. The first sucking opening 15 is so shaped as to cover the tail portion of the bobbin, and the second sucking opening 16 is shaped like a bird's beak. The suction nozzle 4 includes the inlet 4*a* at its bottom, to which a hose 4*b* is connected. The suction is carried out by the fan 4*c* through a filter adapted to remove fibrous dust. The sucking pressure is produced by the fan 4*c*, and it is transmitted to the nozzle 4 through the hose 4*b*. The slit 16*a* is located at the crossing corner of the first and second sucking openings 15 and 16. The yarn ends are guided through the slit 16*a* as shown in FIG. 13.

Figure 10:
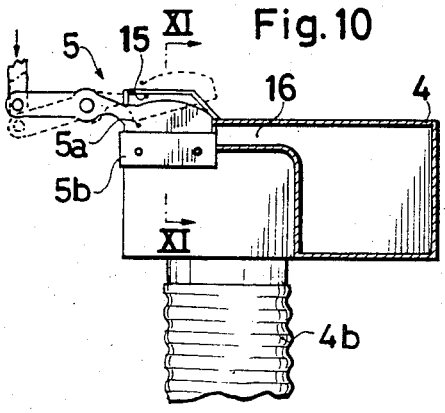
Figure 11:
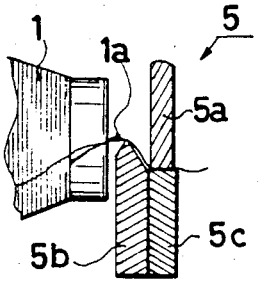
FIG. 11 is a cross-sectional view taken along the XI—XI line in FIG. 10.

Referring to FIG. 8, the nipper unit 5 is located between the first sucking opening 15 and the tail end of the bobbin 2. The nipper units includes fixed plates 5*b* and 5*c* and a swinging nipper 5*a*. FIG. 10 shows a state at which the swinging nipper 5*a* is kept in contact with the fixed plate 5*c*. The top of the fixed plate 5*c* is sufficiently flat to nip the starting end of the yarn 1*a* against the swinging nipper 5*a*. FIG. 13 shows a state at which the swinging nipper 5*a* is raised or opened away from the fixed plate 5*c*. The fixed plate 5*b* has an edge on its top like a blade, and it is slightly longer than the fixed plate 5*c*. The starting end of the yarn 1*a* is nipped by the nipper unit 5 in the manner shown in FIG. 11. More particularly, when the swinging nipper 5*a* is opened, the yarn end 1*a* is sucked into the first sucking opening 15, and, when the swinging nipper 5*a* is closed or lowered, the yarn end 1*a* is caught between the swinging nipper 5*a* and the fixed plate 5*c*. At this stage, when the bobbin is rotated, the yarn is twistingly cut against the fixed plate 5*b*. The cut end of yarn is sucked for removal as a waste.

Figure 12:
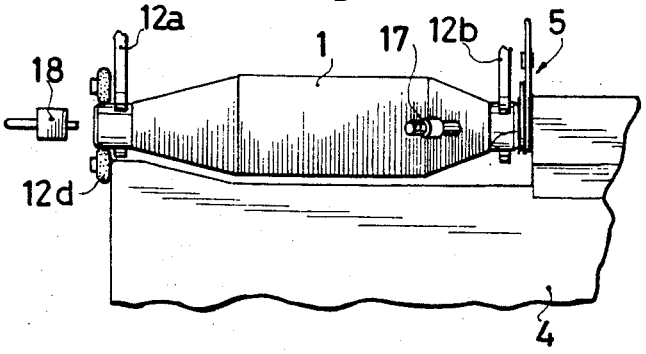
FIG. 12 is a plan view showing a modified version of the embodiment.

At this stage the bobbin 2 is secured in the second sucking opening 16 by suction. The picking end of the yarn is drawn into the inlet 4*a* under guidance provided by the slit 16*a*. The starting end of the yarn 1*a* is sucked into the first sucking opening 15 preferably by the help of a first jet nozzle 17 (FIG. 12) for urging the same toward the first sucking opening 15. The reference numeral 18 designates a second jet nozzle preferably provided for cleaning the dust possibly accumulating in the bore of the bobbin 2, thereby enabling the yarn to pass smoothly therethrough. This also prevents the picking end portion of the yarn from becoming stained with fibrous dust.

The chute 6 is located under the feeder drum 12. The guide 6*a* guides the bobbins 2 so that they fall longitudinally. The guide 6*a* is preferably made of an elastic material so as to lessen the force with which the bobbins 2 strikes the chute 6. The cutter 7 is located at a position opposite to the guide 6*a*. The reference numeral 6*b* (FIG. 13) designates an opening in which the cutter 7 works. The cutter 7 is modelled like scissors. The picking end portion of the yarn is cut to a given length, and the remaining portion of the yarn is sucked into the inlet 4*a* for removal. The picking end portion of the yarn is sucked into the bore 2*a* of the bobbin 2 from top to bottom, while the bobbin 2 is erected on the peg 8*a* on the conveyor 8 in the aforementioned manner.

The reference numeral 19 designates a yarn end regulating device which has a working plate 19*b* pivoted on a fixed shaft 19*a*. The yarn end regulating device 19 prevents an excessive amount of the picking portion of the yarn from being sucked before it is cut by the cutter 7. When a bobbin 2 is dropped onto a peg 8*a*, the working plate 19*b* is brought into contact with the top of the bobbin 2 by a pneumatic cylinder or any other appropriate means. After the picking end 1*b* of the yarn 1 is cut by the cutter 7, the working plate 19*b* is pivoted away from the bobbin 2. Alternatively, it is possible to provide an abutment plate which constantly keeps contact with the yarn on the bobbin.

As is evident from the foregoing description, the present invention has many advantages. One is that the cut length of a tail portion of the yarn can be short. A second is that the possibility of errorneous cutting is eliminated, thereby ensuring that the picking end of yarn is easily found. A third advantage is that it is easy to remove waste yarn.

What is claimed is:

1. An apparatus for facilitating the finding of the picking end portions of yarns wound around bobbins each of which has an axial through bore, said apparatus comprising:

(a) a bobbin holding means for supporting each bobbin horizontally;

(b) a sucking means provided adjacent to said bobbin holding means, said sucking means including:

(i) a first sucking means for subjecting the axial through bore of each bobbin to a longitudinal sucking pressure and (ii) a second sucking means for sucking each bobbin laterally, said second sucking means forming an L-shape with said first sucking means;

(c) a chute for allowing each bobbin to fall down, said chute being sized and shaped so that each bobbin rolls down longitudinally;

(d) a conveyor for receiving the bobbins thereon, said conveyor including hollow pegs sized, shaped, and positioned for erecting the bobbins thereon;

(e) a suction pipe provided under said conveyor so that said suction pipe sucks the air in the axial through bore of each bobbin when said suction pipe is in agreement with each hollow peg;

(f) means for guiding a sucked yarn, said means being provided in said second sucking means;

(g) a first cutting means provided between said bobbin holding means and said first sucking means, said first cutting means being sized, shaped, and positioned so as to cut a tail end of the yarn when each bobbin is subjected to sucking pressure from said first sucking means; and (h) a second cutting means provided between said means for guiding a sucked yarn and said conveyor, said second cutting means being sized, shaped, and positioned so as to cut the picking end portion of the yarn on each bobbin to a fixed length.

2. An apparatus as defined in claim 1 wherein:

(a) said first cutting means comprises a swinging nipper and first and second fixed plates;

(b) said first fixed plate is shorter than said second fixed plate;

(c) said second fixed plate has an edge on its top, whereas the top of said first fixed plate is flat; and (d) said first fixed plate and said swinging nipper nip the yarn therebetween, thereby enabling the yarn to be twistingly cut by said second fixed plate when the yarn is rotated.

3. An apparatus as defined in claim 1 wherein:

(a) said means for guiding a sucked yarn is a slit in said second sucking means and (b) said first sucking means includes an inlet for introducing sucking pressure into said first sucking means.

* * * * *